US005516193A

United States Patent [19]

Simpson

[11] Patent Number: 5,516,193

[45] Date of Patent: May 14, 1996

[54] PORTABLE STADIUM SEAT APPARATUS

[76] Inventor: Barry K. Simpson, R.R. #1, Box 242-5, Warren, Vt. 05674

[21] Appl. No.: 206,607

[22] Filed: Mar. 7, 1994

[51] Int. Cl.[6] ..... A47C 1/16

[52] U.S. Cl. ..... 297/252; 297/352; 297/380; 297/188.01

[58] Field of Search ..... 297/252, 352, 297/380, 381, 188.04, 188.08, 188.01

[56] References Cited

U.S. PATENT DOCUMENTS

| | | | |
|---|---|---|---|
| 116,934 | 7/1871 | Cutter | 297/380 X |
| 2,059,493 | 11/1936 | Schoenhoff | 297/252 |
| 2,107,880 | 2/1938 | Wilsdorf | 297/380 |
| 2,973,888 | 3/1961 | Beardsley | 297/380 X |
| 3,005,659 | 10/1961 | Sanders | 297/380 X |
| 3,066,980 | 12/1962 | Clute | 297/252 |
| 3,120,404 | 2/1964 | Bramming | 297/352 X |
| 4,842,329 | 6/1989 | Owens | 297/188.01 X |
| 5,326,152 | 7/1994 | Baron | 297/188.04 X |

FOREIGN PATENT DOCUMENTS

| | | | |
|---|---|---|---|
| 926425 | 5/1963 | United Kingdom | 297/380 |

*Primary Examiner*—Peter M. Cuomo

*Assistant Examiner*—David E. Allred

*Attorney, Agent, or Firm*—Thomas N. Neiman

[57] ABSTRACT

The portable stadium seat apparatus is comprised of an apparatus designed to be used at spectator events where the seating is flat benches without backs. The apparatus consists, in one embodiment, of a streamlined fabric unit which folds readily into a compact flat pad or rolls up to fit a pocket while providing a padded seat and a vertical back support portion. The more detailed embodiment is a multi-compartment shoulder bag having a similar padded seat and a vertical back support portion and a storage compartment which extends from the seat when the unit is in position on the bench, and a storage compartment which is behind the backrest when the unit is in position. The webbing is attached to a hook that secures the seat to the front edge of the bench. The webbing goes across the bench and over the back edge. A compression member is inserted into a pocket in the webbing to form a rear edge for the seat at the back of the bench. Pressure from the compression member wraps the seat snugly over the back of the bench, adjusting it in so doing to any standard bench. The compression member extends vertically to the top of the back of the seat and is attached thereto. Adjustment devices are attached to the webbing to permit the user to adjust the angle of the backrest.

9 Claims, 3 Drawing Sheets

PORTABLE STADIUM SEAT APPARATUS

BACKGROUND OF THE INVENTION

This invention pertains to portable seats and, in particular, to a portable stadium seat apparatus that is to be used by individuals attending spectator events at facilities having bench type seats.

There have been a number of attempts to develop a comfortable and easy to carry portable seat for spectator events with varying degrees of success. The United States Patent issued to W. J. Bishop et al, U.S. Pat. No. 2,647,563 on 4 Aug. 1953 for a "Collapsible Bleacher Type Back Rest", shows a unit having a complicated mechanism that collapses when not in use. The U.S. Pat. No. 1,584,448 issued to A. J. Garnham on 11 May 1926 for a "Back Rest or Ground Seat" shows a device that uses crossed stakes to provide support for the user and will fold into a small package when not in use.

What is needed is a portable stadium seat apparatus that is designed to be able to be used with any type bench seat and provide a solid attachment to the bench seat and a comfortable back support for the user. What is also needed is a device that does not need to provide a rigid back which will lock into position and will create problems in so doing. What is also needed is a device that will neither press the user forward into the person occupying the bench in front of him, nor will project rearward in a rigid fashion, obstructing the passageway or annoying the person behind him. It is the object of this invention to teach a portable stadium seat apparatus which avoids the disadvantages and limitations, recited above. Another object of this invention is to provide an apparatus that is simple to operate, extremely effective and very cost effective and be extremely adjustable and portable.

SUMMARY OF THE INVENTION

Particularly, it is the object of this invention to teach a portable stadium seat apparatus for use by individuals attending spectator events at facilities having bench type seats in order to provide an elevated level of comfort, comprising horizontal support means; said horizontal support means comprising a fabric material; vertical support means; said vertical support means comprising a fabric material; said vertical support means further comprising at least one rigid support post extending the entire height of said vertical support means; webbing means; said webbing means comprising at least one flexible strapping element for connecting the upper edge of said vertical support means to the leading edge of said horizontal support means; said webbing means having adjustment means connected thereto; and, said webbing means further having at least one bench attachment means connected to said webbing means at said leading edge of said horizontal support means for allowing said bench attachment means to be connected to the leading edge of said bench.

It is another object of this invention to teach a portable stadium seat apparatus, for use by individuals attending spectator events at facilities having bench type seats in order to provide an elevated level of comfort, comprising horizontal support means; said horizontal support means comprising a fabric material; said horizontal support means having at least one utility storage means attached to the leading edge of said horizontal support means; vertical support means; said vertical support means comprising a fabric material; said vertical support means having at least one utility storage means attached to the sides and bottom of said vertical support means; said vertical support means further comprising at least one rigid vertical post extending the entire height of said vertical support means; webbing means; said webbing means comprising at least one flexible strapping element for slideably connecting the upper edge of said vertical support means to the leading edge of said horizontal support means; said webbing means having a shoulder strap constructed of additional webbing means beyond said slideable connection to said vertical support means; said webbing means having adjustment means connected thereto; and, said webbing means further having at least one bench attachment means connected to said webbing means at said leading edge of said horizontal support means for allowing said bench attachment means to be connected to the leading edge of said bench.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 4:
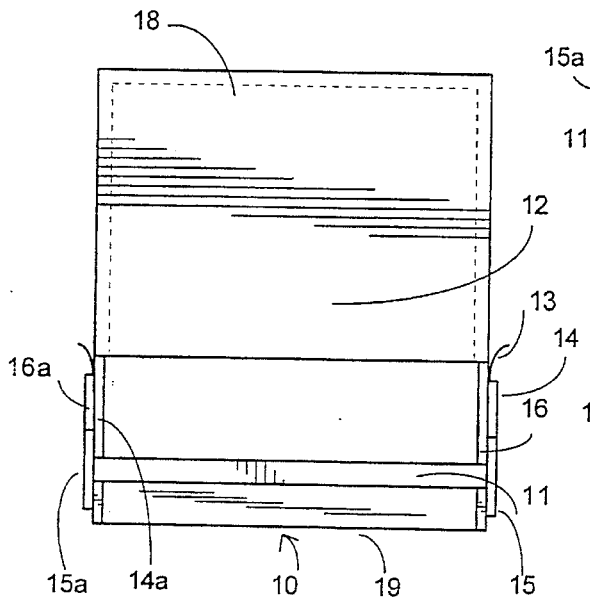
FIG. 4 is a front elevational view thereof.
Figure 2:
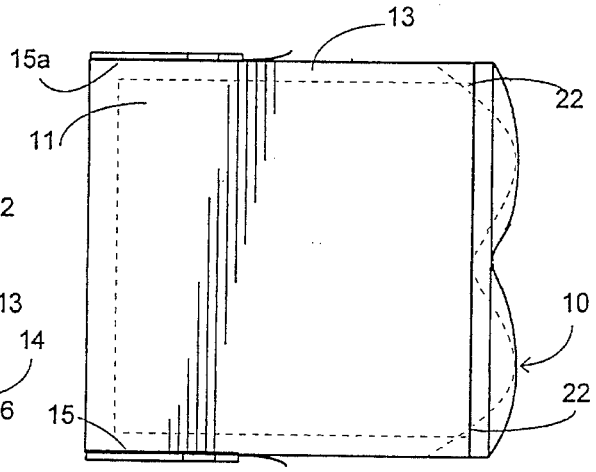
FIG. 2 is a top plan view thereof.
Figure 1:
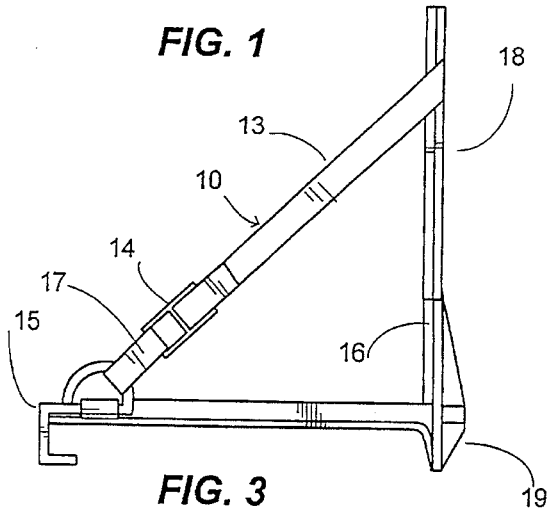
FIG. 1 is a side elevational view of the novel portable stadium seat apparatus.
Figure 5:
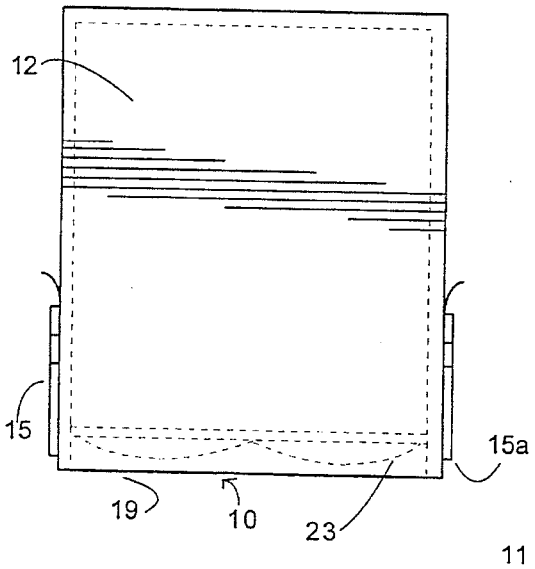
FIG. 5 is a rear elevational view thereof.
Figure 3:
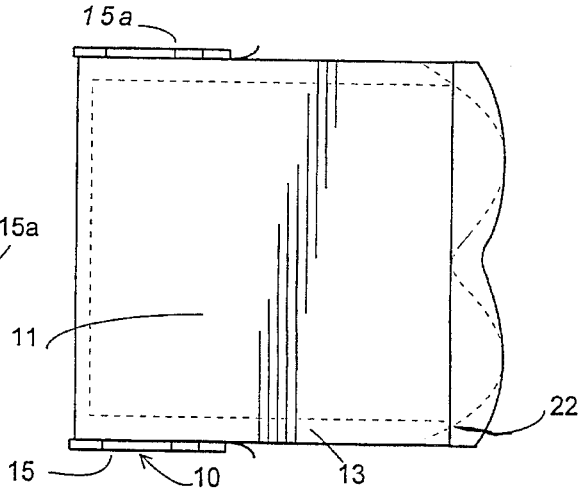
FIG. 3 is a bottom plan view thereof.
Figure 6:
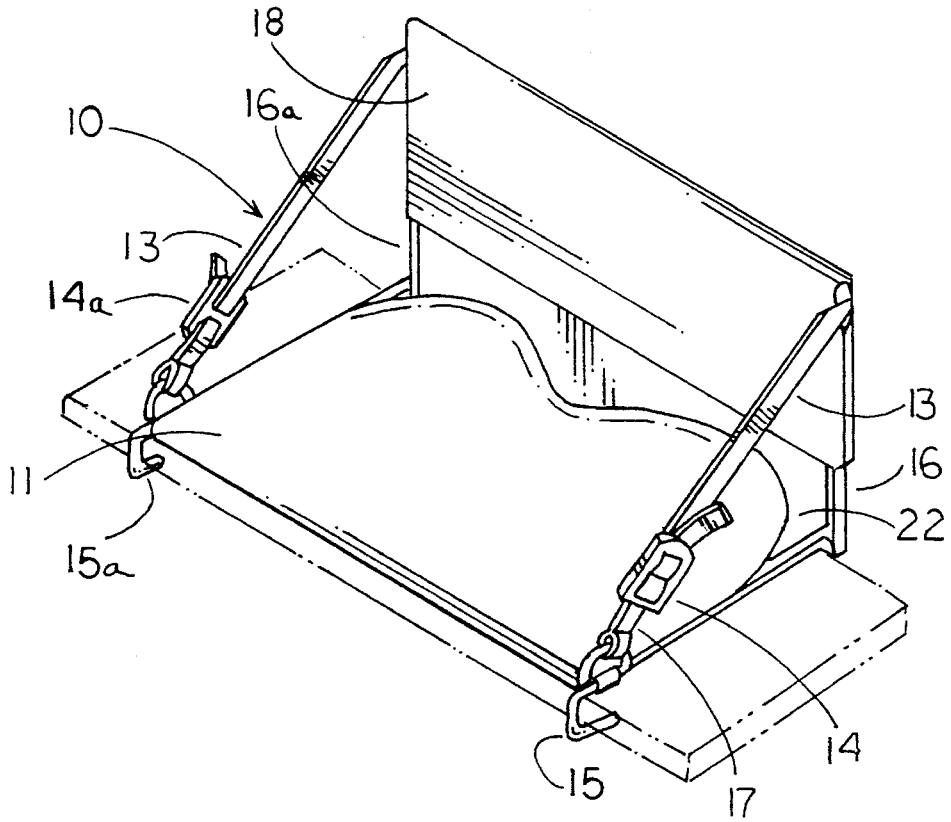
FIG. 6 is a perspective view of the novel portable stadium seat apparatus.
Figure 7:
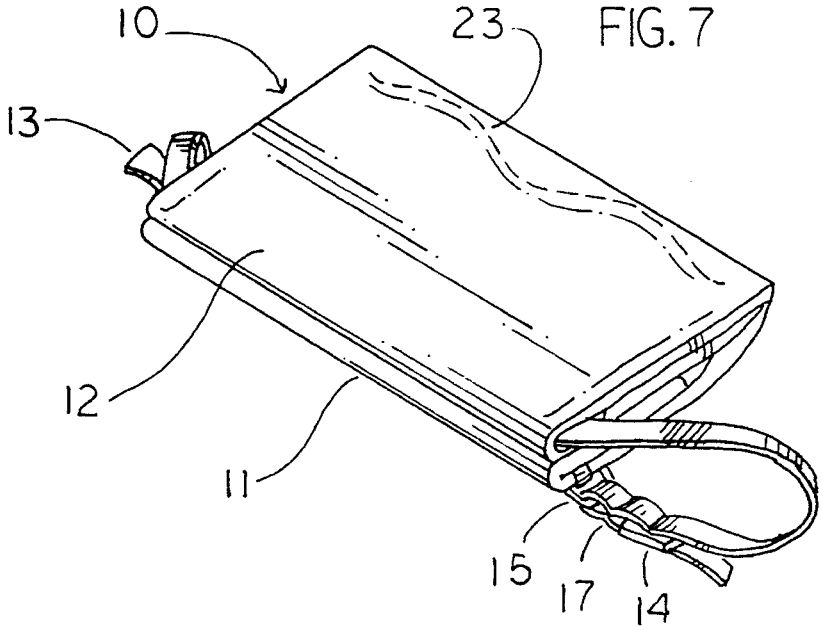
FIG. 7 is a perspective view of the apparatus in the folded position.
Figure 8:
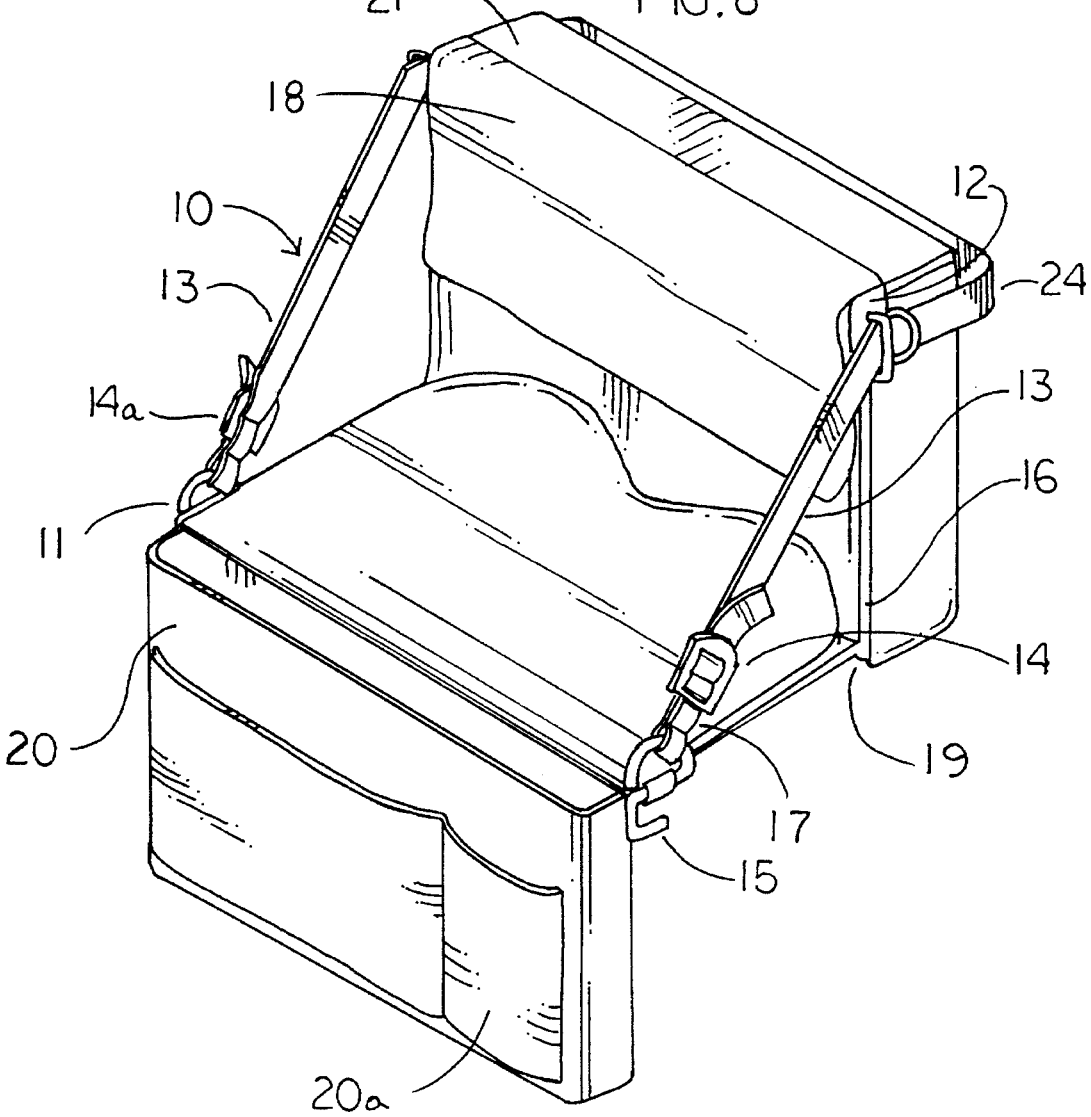
FIG. 8 is a perspective view of an alternative embodiment of the novel apparatus.
Figure 9:
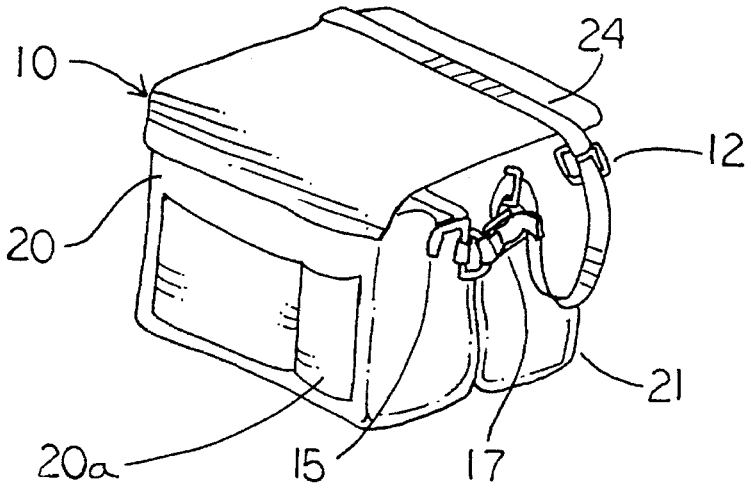
FIG. 9 is a perspective view of the alternate embodiment in the folded position.

As shown in the figures, the novel apparatus 10 comprises a horizontal support seat 11 that is a fabric material in layers with padding between the layers of material. A vertical support back 12 is also made of fabric layers with the upper portion 18 of the back also being padded. The vertical support back 12 and the horizontal support seat 11 are connected by the fabric loop 19 at the rear of the seat and the bottom of the back and become a one piece unit. The webbing element 13 is a flexible strap that is attached to the perimeter of the back and the seat except at the rear edge of the seat where the seat projections part from the side of the seat. It acts as a guide for the rigid vertical rods 16 and **16*a* along the side edges of the vertical support back 12 and the rods or dowels 16 and 16*a* extend the entire height of the vertical support back 12. The webbing element is also attached at the upper edge corners of the vertical support back directly to the frontal edge corners of the horizontal support seat 11. Adjustment buckles 14 and 14*a* are positioned on the webbing elements along this exposed area of the webbing element to permit adjustment of the angle of the back as the user desires. A connection hook 15 and 15*a* are connected to the adjustment buckles by means of a webbing loop 17 which the webbing element 13** wraps around and the position of the back can be adjusted by loosening or tightening the webbing element through the adjustment buckle.

An alternate embodiment is a slightly larger apparatus which has a similarly padded seat and back. It also contains a plurality of pockets 20 and 20*a* which are attached to the leading edge of the horizontal support seat and a pocket 21 which is attached to the vertical support back allowing the unit to have much greater flexibility. The pockets can accommodate a plurality of the preferred embodiments or any combination thereof with blankets, raincoats food or personal items. This apparatus also has a strap 24 which can be attached to the unit when it is folded up to allow the user to have a shoulder carrying strap for the apparatus. This allows the user to carry all sorts of items into the event and carry the unit comfortably. The strap is attached to the webbing element by using O-rings attached to the seat back D-rings. When the user pulls the shoulder strap, the webbing element slide through the D-rings converting the seat to a shoulder bag.

In use, the individual would place either embodiment of the apparatus on the bench with the front of the horizontal support seat along the front edge of the bench and place the connection hooks over the front edge of the bench. The apparatus would then be pushed as far back on the bench as possible and the vertical support back would be raised. As the fabric at the lower portion of the back is drawn against the rear of the bench, it is pulled taut against curved projections 22 at the rear of the padded seat. The switching 23 serves an important role in holding the back surface taut as it gathers the fabric around the seat projections providing friction between the back and the seat. The resulting friction effects a hinge between the seat and back that is resistive to unintentional closure. The combination of the rigid vertical posts extending the entire height of the vertical support back, the projections of the padded horizontal seat extending into the vertical support back and the taut fabric material 19 at the back of the seat and the base of the back will provide a stable vertical support back. The friction caused by the projections of the horizontal support seat into the fabric of the vertical support back held taut by the downward pressure of the rigid vertical rods keeps the back from pivoting around the point at which the back end of the bench contacts the horizontal support seat. The angle of the back is dependent upon the adjustment of the adjustment buckle. It should be noted that the horizontal and vertical supports act independently of each other. When the user's back presses against the back support, the tension on the webbing draws the bench attachment means securely against the front of the bench. The pressure on the rigid vertical support posts wraps the rear edge of the horizontal support seat securely over the back of the bench and adapts the apparatus to the width of the bench. The curved projections of the support seat project into the taut diaphragm of the vertical support back and causes a friction that acts to prevent the overturning of the vertical support back as it must be drawn over the curved projections ends of the padded seat in order to pivot around the back edge of the bench.

While I have described my invention in connection with specific embodiments thereof, it is clearly to be understood that this is done only by way of example and not as a limitation to the scope of my invention as set forth in the objects thereof and in the appended claims.

I claim:

1. A portable stadium seat apparatus for use by individuals attending spectator events at facilities having bench type seats in order to provide an elevated level of comfort, comprising:

horizontal support means;

said horizontal support means comprising a fabric material;

said horizontal support means further comprising a plurality of fabric material layers;

said fabric material layers having cushion means;

said horizontal support means further comprising a curved projection portion at the rear of said horizontal support means for providing a support extension;

said curved projection portion comprising a combination of fabric material and cushion means;

vertical support means;

said vertical support means comprising a fabric material;

said vertical support means having stitching means for holding said fabric material taut;

said vertical support means further comprising at least one rigid vertical support post extending up said vertical support means;

the combination of said curved projection portion of said horizontal support means, the vertical support means and said stitching of said vertical support means comprising means for maintaining said vertical support means in an upright position, wherein said stitching gathers the fabric around the seat projections and provides friction between the horizontal and vertical support means;

webbing means;

said webbing means comprising at least one flexible strapping element for connecting said vertical support means to said horizontal support means;

said webbing means having adjustment means connected thereto;

said webbing means further having at least one bench attachment means connected to said webbing means at a leading edge of said horizontal support means for allowing said bench attachment means to be connected to the leading edge of said bench type seats.

2. A portable stadium seat apparatus, according to claim 1, wherein:

said horizontal support means comprises a plurality of said fabric material layers; and said fabric material layers have cushion means therein.

3. A portable stadium seat apparatus, according to claim 1, wherein:

said vertical support means comprises a plurality of said fabric material layers;

said fabric material layers have cushion means therein.

4. A portable stadium seat apparatus, according to claim 1, wherein:

said rigid vertical support post comprises a dowel; and said rigid vertical support post forms a compression member.

5. A portable stadium seat apparatus, according to claim 1, wherein:

said adjustment means comprises a buckle unit to loosen or tighten said webbing means.

6. A portable stadium seat apparatus, according to claim 1, wherein:

said bench attachment means comprises a rigid hook that is positioned around the front of said bench type seat in order to hold said portable stadium seat apparatus in position on said bench type seats.

7. A portable stadium seat apparatus, for use by individuals attending spectator events at facilities having bench type seats in order to provide an elevated level of comfort, comprising:

horizontal support means;

said horizontal support means comprising a fabric material;

said horizontal support means further having cushion means;

said horizontal support means further comprising a curved projection portion at the rear of said horizontal support means for providing a support extension;

said curved projection portion comprising a combination of fabric material and cushion means;

said horizontal support means having at least one utility storage means attached to said horizontal support means;

vertical support means;

said vertical support means comprising a fabric material;

said vertical support means having stitching means for holding said fabric means taut;

said vertical support means having at least one utility storage means attached to said vertical support means;

said vertical support means further comprising at least one rigid vertical post extending up said vertical support means;

the combination of said curved projection on said horizontal support means, said vertical support means, said stitching of said vertical support means and said vertical support post comprising means for maintaining said vertical support means in an upright position, wherein said stitching gathers the fabric around the seat projections and provides friction between the horizontal and vertical support means;

webbing means;

said webbing means comprising at least one flexible strapping element for slideably connecting said vertical support means to said horizontal support means;

said webbing means having a shoulder strap constructed of additional webbing means which is a portion of said strapping element;

said webbing means having adjustment means connected thereto;

said webbing means further having at least one bench attachment means connected to said webbing means at a leading edge of said horizontal support means for allowing said bench attachment means to be connected to the leading edge of said bench type seat.

8. A portable stadium seat apparatus, according to claim 7, wherein:

said rigid vertical post comprises a dowel; and said rigid vertical post forms a compression member.

9. A portable stadium seat apparatus, according to claim 7, wherein:

said webbing means having o-rings for providing slideable connection of said webbing means to said upper edge of said vertical support means for permitting the drawing of said leading edge of said horizontal support means against said vertical support means forming a carrying bag to be supported by said shoulder strap and having a plurality of said utility storage means.

* * * * *